US009818562B2

(12) United States Patent
Sato et al.

(10) Patent No.: US 9,818,562 B2
(45) Date of Patent: Nov. 14, 2017

(54) SWITCH

(71) Applicant: Hitachi Industrial Equipment Systems Co., Ltd., Tokyo (JP)

(72) Inventors: Takashi Sato, Tokyo (JP); Ayumu Morita, Tokyo (JP); Makoto Yano, Tokyo (JP); Kenji Tsuchiya, Tokyo (JP); Akio Nakazawa, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/416,652

(22) PCT Filed: Jun. 26, 2013

(86) PCT No.: PCT/JP2013/067433

§ 371 (c)(1),
(2) Date: Jan. 23, 2015

(87) PCT Pub. No.: WO2014/017241

PCT Pub. Date: Jan. 30, 2014

(65) Prior Publication Data

US 2015/0206676 A1 Jul. 23, 2015

(30) Foreign Application Priority Data

Jul. 24, 2012 (JP) ..... 2012-163215

(51) Int. Cl.
*H01H 33/14* (2006.01)
*H01H 33/666* (2006.01)
(Continued)

(52) U.S. Cl.
CPC ..... *H01H 33/666* (2013.01); *H01H 33/14* (2013.01); *H01H 33/59* (2013.01);
(Continued)

(58) Field of Classification Search
CPC .. H01H 33/666; H01H 33/14; H01H 33/6662; H01H 50/86; H01H 50/62; H01H 2033/146; H01H 3/28
See application file for complete search history.

(56) References Cited

U.S. PATENT DOCUMENTS 3,038,980 A 12/1959 Lee
3,708,638 A 1/1973 Mitchell
(Continued)

FOREIGN PATENT DOCUMENTS

DE 10 2005 013 196 A1 9/2006
EP 0 593 902 A1 4/1994
(Continued)

OTHER PUBLICATIONS

Translation of Japanese Office Action received in corresponding Japanese Application No. 2012-163215.
(Continued)

*Primary Examiner* — Ramon M Barrera
(74) *Attorney, Agent, or Firm* — Mattingly & Malur, PC

(57) ABSTRACT

Provided is a reliable switch having a contact surface that is prevented from being roughened. To solve the problem, there is provided a switch including a plurality of switching units 2 and 3 each including a fixed electrode and a movable electrode that is disposed to be opposed to the fixed electrode and is closed or opened with respect to the fixed electrode, the switch being characterized in that the switching units 2 and 3 each make or break a current to be applied to the switch, the switching units 2 and 3 are electrically connected in series to each other, and the switching units 2 and 3 are each configured such that a first switching unit 3 is first closed, and then a second switching unit 2 is closed.

10 Claims, 7 Drawing Sheets

(51) Int. Cl.

| | |
|---|---|
| ***H01H 33/59*** | (2006.01) |
| ***H01H 50/62*** | (2006.01) |
| ***H01H 50/86*** | (2006.01) |
| *H01H 3/28* | (2006.01) |
| *H01H 7/00* | (2006.01) |

(52) U.S. Cl.

CPC ..... *H01H 33/6662* (2013.01); *H01H 50/62* (2013.01); *H01H 50/86* (2013.01); *H01H 3/28* (2013.01); *H01H 7/00* (2013.01)

(56) References Cited

U.S. PATENT DOCUMENTS

| | | | |
|---|---|---|---|
| 3,813,506 | A | 5/1974 | Mitchell |
| 7,483,254 | B1 | 1/2009 | Wang |
| 2007/0262054 | A1 | 11/2007 | Sato et al. |
| 2008/0156775 | A1 | 7/2008 | Morita et al. |
| 2008/0191821 | A1 | 8/2008 | Protze |

FOREIGN PATENT DOCUMENTS

| | | | |
|---|---|---|---|
| EP | 0 867 903 | A2 | 9/1998 |
| EP | 1 119 009 | A1 | 7/2001 |
| EP | 1 416 503 | A2 | 5/2004 |
| GB | 2175447 | | 11/1986 |
| JP | 61-237326 | | 10/1986 |
| JP | 4-39829 | | 2/1992 |
| JP | H04179016 | A | 6/1992 |
| JP | 05-081973 | | 4/1993 |
| JP | 8-212879 | A | 8/1996 |
| JP | WO00/21104 | A1 | 4/2000 |
| JP | 2003-530672 | | 10/2003 |
| JP | 2004241204 | A | 8/2004 |
| JP | 2004-362889 | A | 12/2004 |
| JP | 2006-32121 | | 2/2006 |
| JP | 2007-335401 | | 12/2007 |
| JP | 2008-166085 | | 7/2008 |
| WO | 0178097 | | 10/2001 |

OTHER PUBLICATIONS

International Search Report in PCT/JP2013/067433, dated Aug. 6, 2013.

Chinese Office Action received in corresponding Chinese Application No. 201380030802.0 dated Dec. 22, 2015.

Extended European Search Report; Application No. 13822856.4; dated Mar. 10, 2016.

Communication Pursuant to Article 94(3) EPC received in corresponding European Application No. 13 822 856.4 dated Aug. 16, 2017.

SWITCH

TECHNICAL FIELD

The present invention relates to a switch, more specifically relates to a switch including a plurality of switching units disposed in series.

BACKGROUND ART

A rapid-transit railway such as the Shinkansen adopts an AC electrification system to secure large power. Since power is supplied from individual substations, a section is provided to isolate a neighbor power source. Such a configuration is specifically illustrated in FIG. 11. An dead section 100 is disposed at an appropriate place in order to isolate the power supplies G1 and G2 from each other. The dead section 100 has a length set to about 1 km. When a train 101 passes through the dead section 100, a section switch VS1 is first closed to charge the dead section 100. While the train 101 passes through the dead section 100, the section switch VS1 is opened and the section switch VS2 is closed, so that a charge source for the dead section 100 is changed from G1 to G2. Discharged time during this operation is controlled to about 0.05 to 0.3 sec, so that the train 101 can pass through the dead section 100 still at high speed without coasting. When the train 101 has passed through the dead section 100, the section switch VS2 is opened.

Examples of existing switches include a switch described in Patent Literature 1 that is however different from the above-described switch for the rapid-transit railway. Patent Literature 1 describes a DC breaker for DC current breaking in which a plurality of energizing vacuum breakers and breaking vacuum breakers disposed in parallel to the energizing vacuum breakers are provided between a DC power supply and a reactor as a load, and the breaking vacuum breakers are disposed in parallel to one another. In Patent Literature 1, the energizing vacuum breakers are provided separately from the breaking vacuum breakers. During energization, the breaking vacuum breakers are opened, while the energizing vacuum breakers are closed. On the other hand, during braking, the breaking vacuum breakers are first closed, and then the energizing vacuum breakers are opened to commutate a current to each breaking vacuum breaker, and then the breaking vacuum breakers disposed in series are sequentially opened, so that the DC current is finally decreased to zero through attenuation according to a predetermined time constant given by a series circuit of resistances provided in parallel to the breaking vacuum breakers and the reactor.

CITATION LIST

Patent Literature

Patent Literature 1: Japanese Patent Application Laid-Open No. H05-81973

SUMMARY OF INVENTION

Technical Problem

When the above-described operating method is applied to the section switches VS1 and VS2, the following problem occurs. The section switch VS2 is closed during passing of the train 101 to make a load current. When the section switch VS2 is opened, the train 101 has passed through the dead section 100, and the section switch VS2 is opened at no load. If the load current is repeatedly made, a contact surface in the switch is roughened due to pre-arc. If the load current is broken, the electrode surface is smoothed by arc generated during the breaking. In the case of the section switch VS2, however, since load making and no-load breaking are repeated, the contact surface is gradually roughened, leading to a possibility of lowering of withstanding voltage. If interelectrode breakdown occurs in the section switch VS2, short circuit occurs between the power supplies G1 and G2, which leads to a serious accident that may disturb train service. Patent Literature 1 basically does not consider such roughening of the contact surface.

An object of the invention is therefore to provide a reliable switch having a contact surface that is prevented from being roughened.

Solution to Problem

To solve the above-described problem, according to the invention, there is provided a switch including a plurality of switching units each including a fixed electrode and a movable electrode that is disposed to be opposed to the fixed electrode and is closed or opened with respect to the fixed electrode, the switch being characterized in that the switching units each make or break a current to be applied to the switch, the switching units are electrically connected in series to each other, and the switching units are configured such that a first switching unit is first closed, and then a second switching unit is closed.

Advantageous Effects of Invention

According to the present invention, it is possible to provide a reliable switch having a contact surface that is prevented from being roughened.

DESCRIPTION OF EMBODIMENTS

Hereinafter, some preferred embodiments of the present invention will be described with reference to the accompanying drawings. The following description merely shows example embodiments, and the subject matter of the invention is not limited to the following specific modes. It will be appreciated that the invention can also be modified or altered into various modes in addition to the following modes.

Embodiment 1

Figure 1:
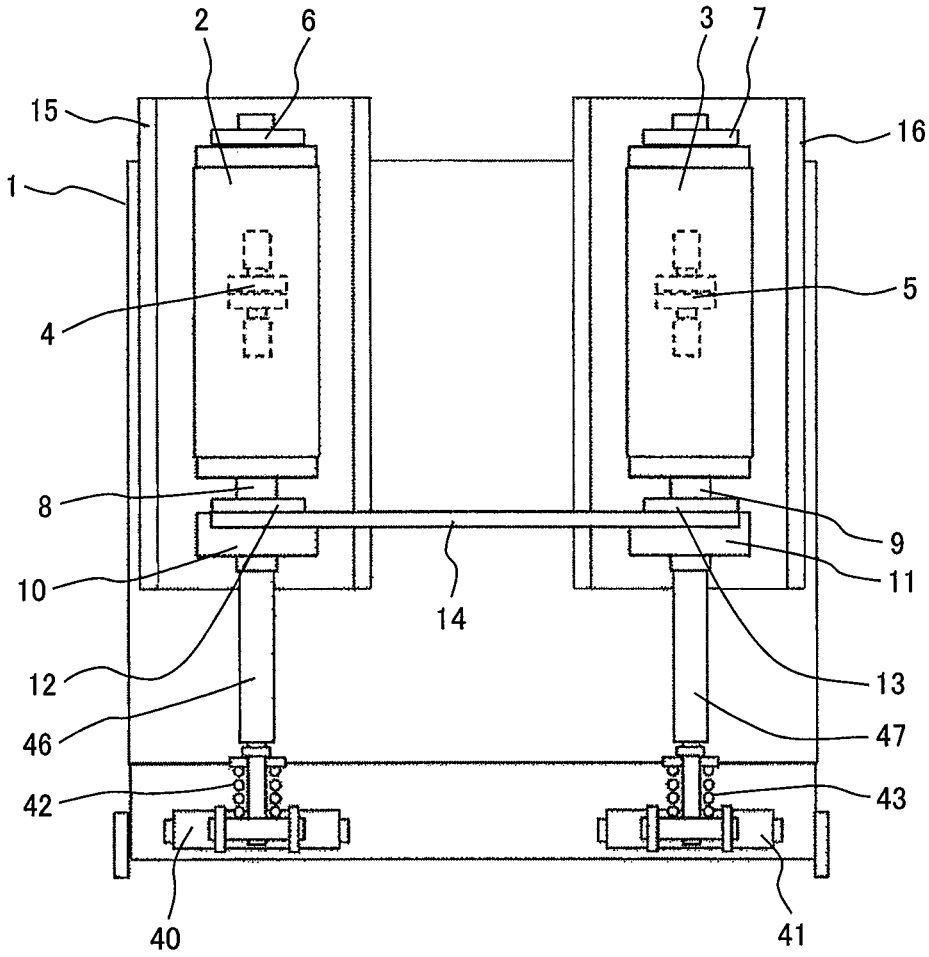
FIG. 1 is a rear view of a switch according to Embodiment 1.
Figure 2:
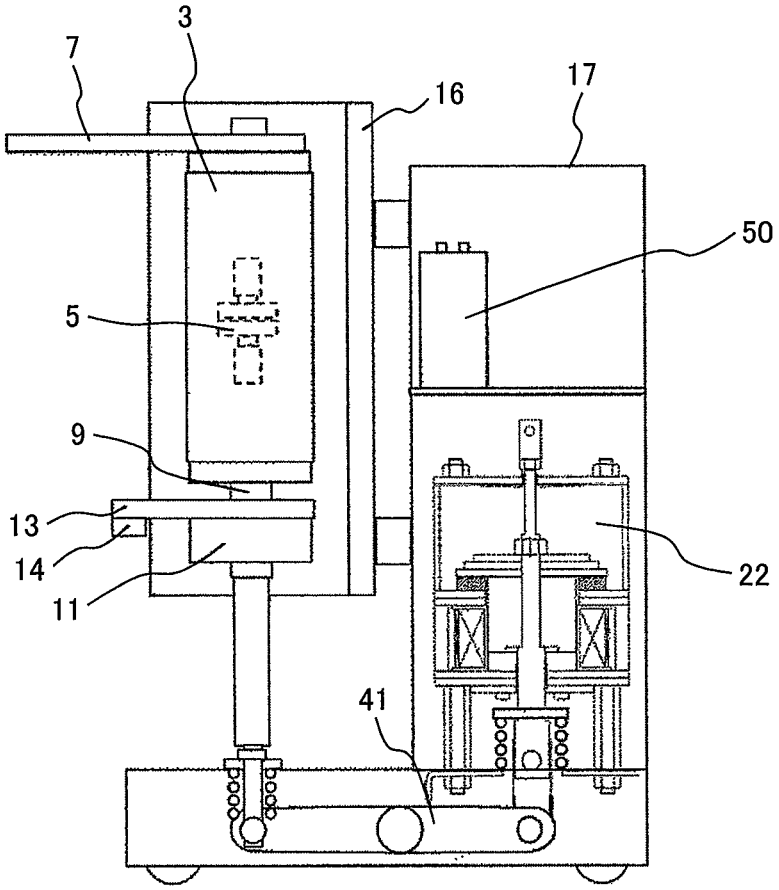
FIG. 2 is a sectional side view of the switch according to Embodiment 1.

A switch according to Embodiment 1 is now described with reference to FIGS. 1 to 6. As illustrated in FIGS. 1 and 2, a switch 1 includes vacuum interrupters 2 and 3 each having a vacuum inside, and operational units each including an electromagnet (in Embodiment 1, the vacuum interrupter 2 and a breaking vacuum interrupter 2, or the vacuum interrupter 3 and a disconnecting vacuum interrupter 3 are assumed to be equivalent to each other).

The vacuum interrupters 2 and 3 internally accommodate electrode pairs 4 and 5 each including a fixed electrode and a movable electrode that is disposed to be opposed to the fixed electrode and is closed or opened with respect to the fixed electrode. Each of the electrode pairs 4 and 5 is opened or closed (is into a contact or separate state) while the vacuum state is maintained, thereby the circuit is allowed to be made or broken. The breaking vacuum interrupter 2 has a current breaking function, and the disconnecting vacuum interrupter 3 has an anti-surge function. Conductors 6 and 7 for connection to a power supply or a load are fixed to upper sides of the vacuum interrupters 2 and 3, respectively. Movable conductors 8 and 9 are provided on the lower sides of the vacuum interrupters 2 and 3 while being connected to movable-side electrodes and disposed to penetrate through the vacuum interrupters 2 and 3, respectively. The movable conductors 8 and 9 extend to the respective outsides of the vacuum interrupters and are electrically connected to current collectors 10 and 11, respectively. The current collectors 10 and 11 are fixed to conductors 12 and 13, respectively, and are connected to each other by a connecting conductor 14. Specifically, the breaking vacuum interrupter 2 and the disconnecting vacuum interrupter 3 are connected in series via the connection conductor 14. The movable conductor 8 is connected to an insulative operating rod 46 that is connected to a wipe spring 42 to be connected to the insulative operating rod 46 and a shaft 40. The movable conductor 9 is connected to an insulative operating rod 47 that is connected to a wipe spring 43 to be connected to the insulative operating rod 47 and a shaft 41. The shaft 41 is connected to an electromagnet 22.

The breaking vacuum interrupter 2 and the disconnecting vacuum interrupter 3 are peripherally covered with insulators 15 and 16, respectively, and are fixed to a housing 17 on an electromagnet side with the respective insulators 15 and 16 in between, so that electrical isolating performance under high voltage is secured.

An operating unit for the breaking vacuum interrupter 2 and the disconnecting vacuum interrupter 3 is now described.

Figure 3:
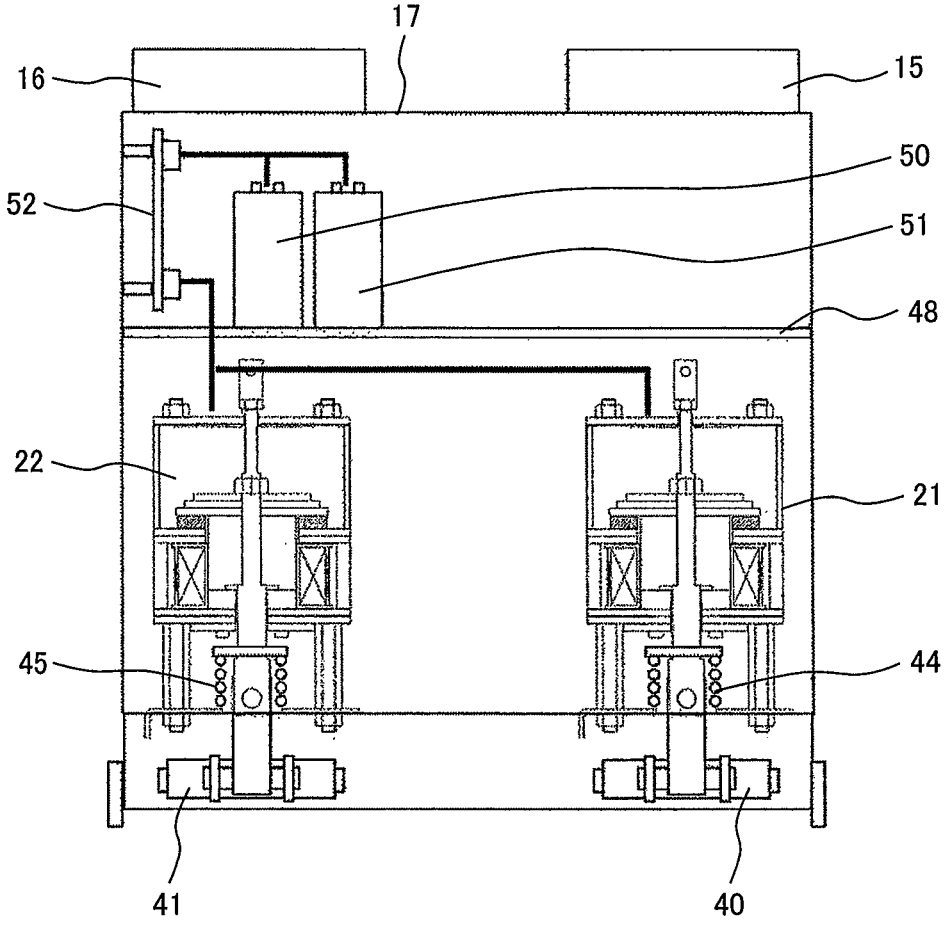
FIG. 3 is an overall structural diagram of an operational unit of the switch according to Embodiment 1.

The breaking vacuum interrupter 2 and the disconnecting vacuum interrupter 3 are connected to electromagnets 21 and 22, respectively. As illustrated in FIG. 3, the housing 17 internally accommodates the electromagnets 22 on its lower side, and accommodates capacitors 50 and 51 and a control circuit board 52 on its upper side on/above a support plate 48 located above the electromagnets 22. The capacitors 50 and 51 are connected in parallel to the control circuit board 52, and are connected to the electromagnets 21 and 22, respectively, via the control circuit board 52. A breaking spring 44 is disposed on a lower side of the electromagnet 21, and the breaking spring 44 is compressed or released depending on a position of a non-magnetic material rod 34 described later. A breaking spring 45 is also disposed on a lower side of the electromagnet 22, and the breaking spring 45 is compressed or released depending a position of a non-magnetic material rod 34 provided in the electromagnet 22.

Figure 4:
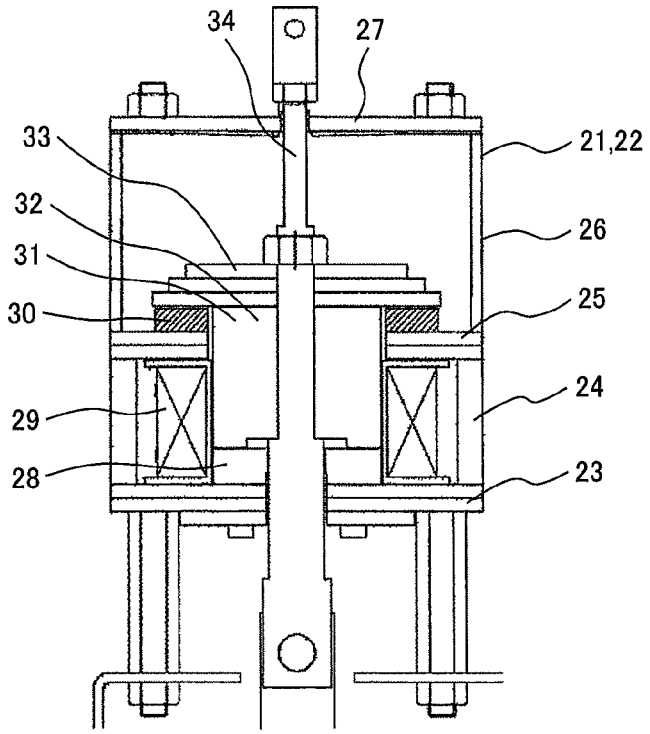
FIG. 4 is a sectional view of an electromagnet of the operational unit of the switch according to Embodiment 1.

FIG. 4 illustrates a section of the electromagnet 21 or 22. In Embodiment 1, the same electromagnet is used for the electromagnets 21 and 22 that therefore have the same configuration; hence, the electromagnets 21 and 22 are collectively described. The electromagnet 21 or 22 is configured of a stack of a lower iron plate 23, a cylindrical steel pipe 24 that is provided above the lower iron plate 23 while being in contact with a peripheral end of the lower iron plate 23 and is disposed so as to cover the periphery of a coil 29 described later, a permanent magnet base 25 disposed above the steel pipe 24 and the coil 29 while being in contact with the upper side of the steel pipe 24, a cylindrical steel pipe 26 provided above a peripheral end of the permanent magnet base 25, and an upper iron plate 27 that is provided on the steel pipe 26 so as to act as a lid-like member for the steel pipe 26. The electromagnet 21 or 22 internally accommodates a coil 29 disposed on an inner side of the steel pipe 24, a central leg 28 that is disposed on an inner side of the coil 29 and on the lower iron plate 23, a T-shaped movable iron core 31 disposed on the central leg 28, and a permanent magnet 30 disposed on the permanent magnet base 25. The T-shaped movable iron core 31 is configured of a plunger 32 disposed above the central leg 28, and a movable flat plate 33 disposed above the plunger 32. The permanent magnet 30 is vertically sandwiched by the movable flat plate 33 and the permanent magnet base 25. A rod 34 made of a nonmagnetic material such as stainless steel vertically runs through the center of each of the movable iron core 31 and the central leg 28. The rod 34 is connected to the shaft 40 or 41 in the outside on the lower side of the electromagnet 21 or 22. FIG. 4 illustrates a state of the electromagnet 21 or 22 while the contact pair is made. Magnetic flux generated by the permanent magnet 30 flows along a path including, in sequence, the permanent magnet 30, the movable flat plate 33, the plunger 32, the central leg 28, the lower iron plate 23, the steel pipe 24, the permanent magnet base 25, and the permanent magnet 30, and causes attractive force between the plunger 32 and the central leg 28, and between the movable flat plate 33 and the permanent magnet 30. FIG. 4 shows a closed state of the electromagnet 21 or 22, in which the wipe spring 42 or 43 (illustrated in FIG. 1) for providing contact force to the electrode and the breaking spring 44 or 45 (illustrated in FIG. 3) for opening the electromagnet 21 or 22 are compressed. The closed state is maintained by the attractive force of the permanent magnet 30.

To describe the operation of the electromagnet 21 or 22, when the electromagnet 21 or 22 is closed, the coil 29 is excited such that magnetic flux is generated in the same direction as that of the magnetic flux generated by the permanent magnet 30. When the electromagnet 21 or 22 is opened, the coil 29 is excited in a direction opposite to that in closing to cancel the magnetic flux generated by the permanent magnet 30, so that the electromagnet 21 or 22 is allowed to operate by the force of the wipe spring 42 or 43 and the force of the breaking spring 44 or 45.

Figure 5:
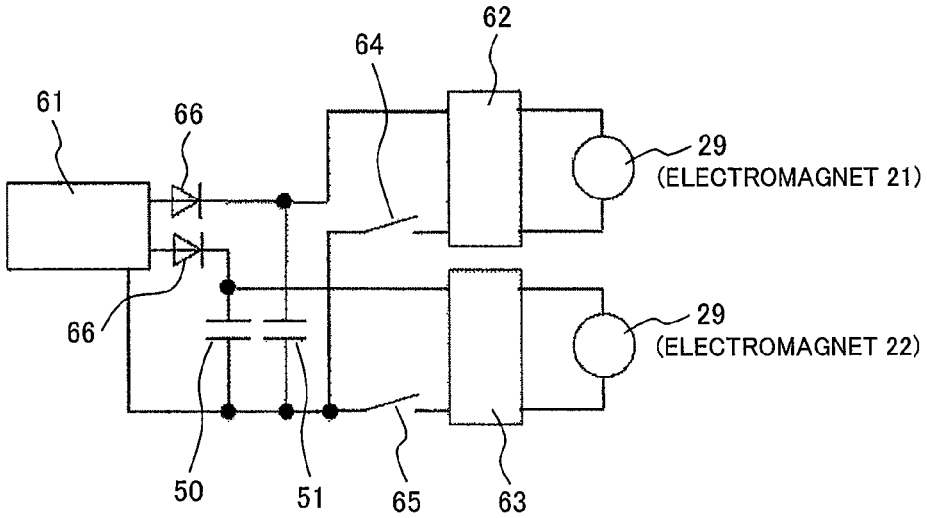
FIG. 5 is a diagram of a control circuit for driving two electromagnets in the switch according to Embodiment 1.

The coil 29 is excited using power stored in the capacitor 50 or 51. FIG. 5 illustrates a circuit configuration of the control circuit board 52. The capacitors 50 and 51 are connected in parallel to a charging circuit 61 via diodes 66 so as to be allowed to be discharged independently of each other. The capacitors 50 and 51 are connected to the coils 29 via respective circuits 62 and 63 for changing the exciting direction between the closing and the opening.

Main switches 64 and 65 are provided between the capacitors 50 and 51 and the circuits 62 and 63, respectively. When the main switch 64 is closed, the capacitor 51, the circuit 62, and the coil 29 of the electromagnet 21 form a closed circuit, and discharge of the capacitor 51 is started, but the capacitor 50 is not discharged since the diode 66 is provided. Conversely, when the main switch 65 is closed, the capacitor 50, the circuit 63, and the coil 29 of the electromagnet 22 form a closed circuit, and discharge of the capacitor 50 is started, but the capacitor 51 is not discharged since the diode 66 is provided. In this way, the main switches 64 and 65 are changeably switched, and therethrough it is possible to control timing at which the power stored in each capacitor is discharged to the coil 29 of each of the electromagnets 21 and 22, i.e., opening-and-closing timing of each of the breaking vacuum interrupter 2 and the disconnecting vacuum interrupter 3.

Figure 6:
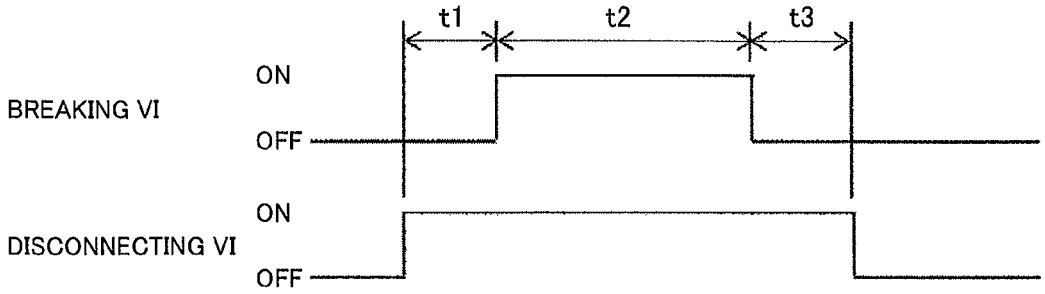
FIG. 6 is a schematic illustration of operation timings of two vacuum interrupters in the switch according to Embodiment 1.

Specifically, the timing is set as illustrated in FIG. 6. In making (ON), the disconnecting vacuum interrupter 3 is first made (closed), and then the breaking vacuum interrupter 2 is made. Since the contact pairs in the two vacuum interrupters are connected in series, the power supply is effectively connected to the load at making of the breaking vacuum interrupter 2 that is made second. In breaking (OFF), the breaking vacuum interrupter 2 first starts opening operation, and then the disconnecting vacuum interrupter 3 starts opening operation.

Figure 11:
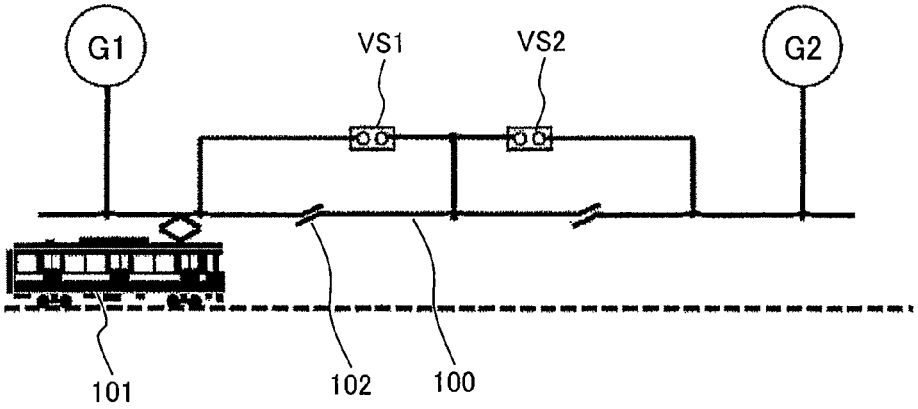
FIG. 11 is a diagram for explaining a role of a section switch.

Effects of the invention are now described. A vacuum switch is typically used for the section switches VS1 and VS2 illustrated in FIG. 11. In the case of the above-described operating method, since the section switch VS2 is repeatedly subjected to load making and no-load breaking, the contact surface of the section switch VS2 is gradually roughened, leading to a possibility of lowering of withstanding voltage. In contrast, according to the switch 1 according to Embodiment 1, the disconnecting vacuum interrupter 3 is made or broken at no load in each case, and thus roughening of the contact surface limitedly occurs in the breaking vacuum interrupter 2, and initial electrical isolating performance of the disconnecting vacuum interrupter 3 can be maintained. As described in Japanese Patent Application No. 2012-059632, the electrode pair of the breaking vacuum interrupter 2 can be improved in breaking performance by disposing an Ag—W—C material as a low-surge material in a contact surface. More preferably, a portion to be roughened of the contact surface is beforehand specified (collected), and the material, which allows the contact surface to be less roughened, is disposed in that portion. The interelectrode breakdown in the section switch leads to a serious accident that causes short-circuit between different power supplies; hence, it is significant that isolating reliability is improved by the switch described in Embodiment 1. The roughening of the contact surface is particularly greatly affected by load making. Hence, opening operation may not be necessarily performed at such timings that the breaker is first opened and then the breaker disconnector is opened, and operation timing may be shifted only in closing operation.

To avoid pre-arc of the disconnecting vacuum interrupter 3 in closing operation, operation time is desirably shifted by 10 ms or more to sufficiently secure an gap distance of the breaking vacuum interrupter 2 connected in series to the disconnecting vacuum interrupter 3. The reason for setting the shift time to 10 ms or more is as follows: a half cycle of 50 Hz passes within such a period at least one time, and thus at least one voltage peak exists in the period. To generalize this, operation time should be shifted by at least a half cycle of an AC frequency, i.e., by at least $(1\times10^3)/(2\times X)$ [ms] with respect to a power supply of an AC frequency X [Hz]. In breaking operation, assuming that arc is igniting during one cycle in breaking, the disconnecting vacuum interrupter 3 is desirably opened by 20 ms or more later than the breaking vacuum interrupter 2. The reason for setting the delay to 20 ms or more is as follows: one cycle of 50 Hz passes within such a period at least one time, and thus at least two current zero point exists in the period, and consequently the AC current can be broken. To generalize this, operation time should be shifted by at least one cycle of an AC frequency, i.e., by at least $(1\times10^3)/X$ [ms] with respect to a power supply of an AC frequency X [Hz].

Although Embodiment 1 has been described with a case where the electromagnets 21 and 22 are used in the operating unit, it is obvious that the electromagnets do not exclusively perform one or both of (1) making (closing) operation where the disconnecting vacuum interrupter 3 is made (closed) prior to the breaking vacuum interrupter 2 and subsequently the breaking vacuum interrupter 2 is made, and (2) opening operation where the disconnecting vacuum interrupter 3 first starts opening and then the breaking vacuum interrupter 2 starts opening, and an electric motor charged spring operating unit or pneumatic operating unit is also allowed to provide similar effects.

According to Embodiment 1, a plurality of switching units are electrically connected in series to each other, and the switching units are configured such that the disconnecting vacuum interrupter 3 as a first switching unit is first closed, and then the breaking vacuum interrupter 2 as a second switching unit is closed; hence, since one vacuum interrupter (the disconnecting vacuum interrupter 3 in the above-described operation) is closed at no load in each case, a reliable switch having a contact surface being prevented from being roughened can be provided without degrading electrical isolating performance.

Embodiment 2

Figure 7:
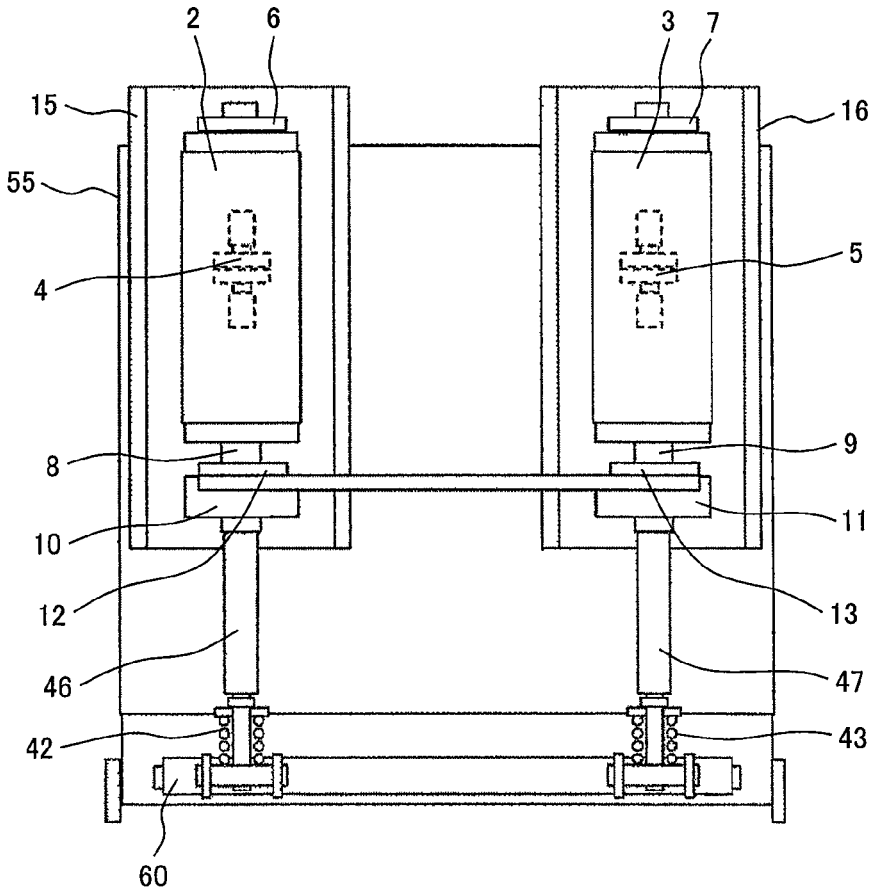
FIG. 7 is a rear view of a switch according to Embodiment 2.
Figure 8:
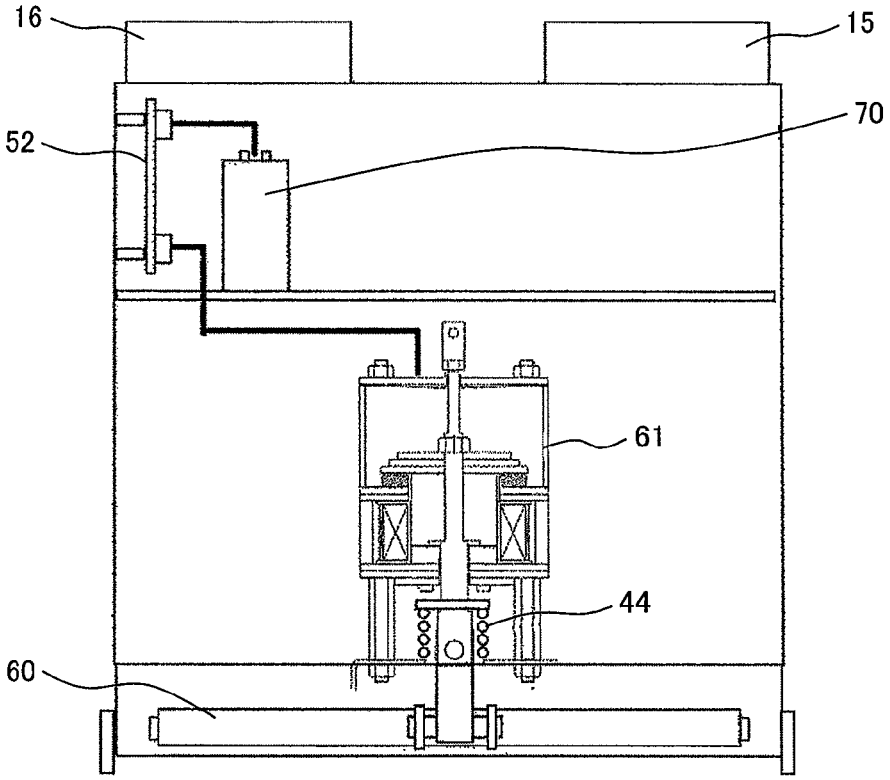
FIG. 8 is an overall structural diagram of an operational unit of the switch according to Embodiment 2.
Figure 9:
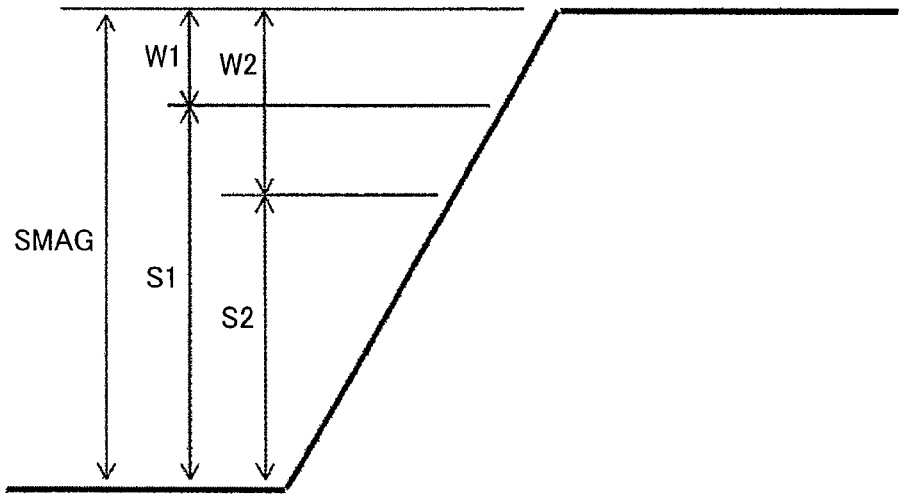
FIG. 9 is a diagram illustrating stroke characteristics in closing of the switch according to Embodiment 2.

Embodiment 2 is now described with reference to FIGS. 7 to 9. In Embodiment 2, the breaking vacuum interrupter 2 and the disconnecting vacuum interrupter 3 are driven with a common shaft 60 and a common electromagnet 61. A single capacitor 70 is provided in accordance with the single electromagnet 61. While not shown, the single capacitor 70 allows the circuit configuration of the control circuit board 52 to be accordingly changed from the dual circuit into a single circuit including one diode and one main switch. The single electromagnet is disposed at the center of the housing 17 to avoid tilt of the shaft 60. Other configurations are similar to those in Embodiment 1, and duplicated description is omitted. FIG. 9 illustrates stroke characteristics in closing. In a switch 55 of Embodiment 2, the stroke length of the electromagnet 61 (accurately, a value converted into a moved distance on a vacuum interrupter side with a relative ratio of length of a lever of the shaft 60 from a rotation axis) SMAG is equal to the sum of an gap distance S1 of the vacuum interrupter 2 and wipe length W1, and to the sum of an gap distance S2 of the vacuum interrupter 3 and wipe length W2.

In other words, when the gap distance (a distance between the movable electrode and the fixed electrode of the switching unit) of the disconnecting vacuum interrupter 3 in the opened state is set shorter than the gap distance of the breaking vacuum interrupter 2 in the opened state, the disconnecting vacuum interrupter 3 is first made, so that effects similar to those described in Embodiment 1 can be exhibited.

According to Embodiment 2, the number of components such as the electromagnets and the capacitors can be decreased, and the control circuit can be simplified, and consequently the switch can be achieved in a simple configuration.

Embodiment 3

Figure 10:
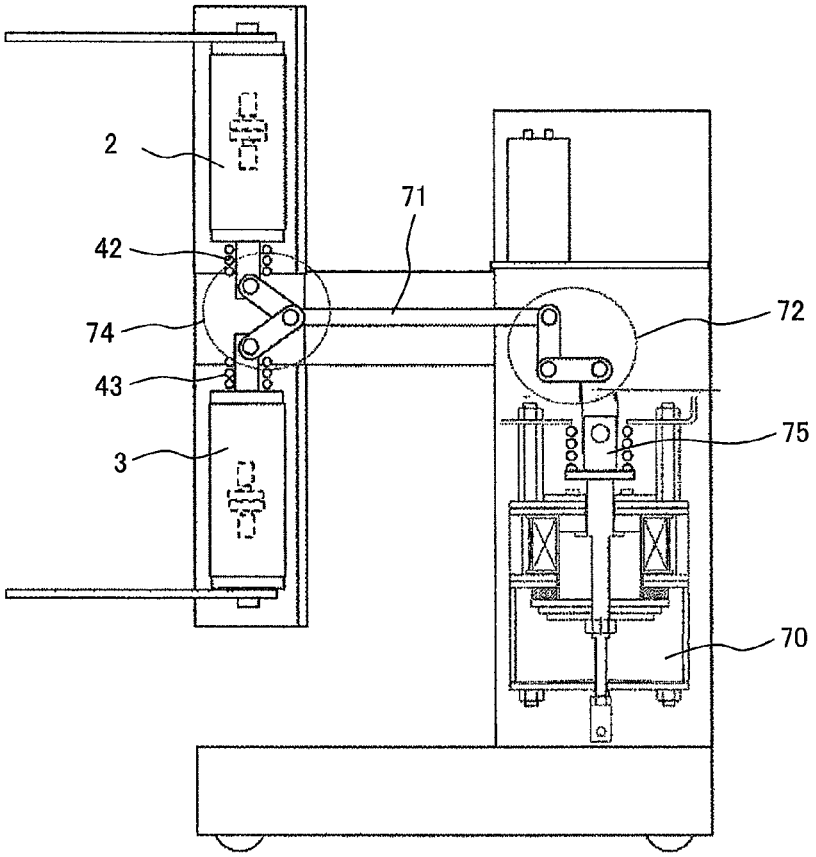
FIG. 10 is a sectional side view of a switch according to Embodiment 3.

Embodiment 3 is now described with reference to FIG. 10. In Embodiment 3, the switch described in Embodiment 2 is modified such that the breaking vacuum interrupter 2 and the disconnecting vacuum interrupter 3 are arranged in a vertical direction to reduce footprint. Although FIG. 10 looks similar to FIG. 2 in Embodiment 1 at the first glance, when the switch is viewed in a front or back direction, only one electromagnet 70 is provided, and the breaking vacuum interrupter 2 and the disconnecting vacuum interrupter 3 occupy area corresponding to one vacuum interrupter in a horizontal direction (since the two vacuum interrupters are stacked in a vertical direction); hence, the occupied area is actually about half the area of the vacuum interrupters in FIG. 2.

In this case, vertical power of a rod 75, which is driven in a vertical direction, is converted into horizontal power. Hence, an operating-unit-side link unit 72 is connected to the rod 75, and a shaft 71 that moves in a horizontal direction is connected to the operating-unit-side link unit 72. In addition, a switching-unit-side link unit 74, which is vertically branched across the shaft 71, is provided on a vacuum interrupter side of the shaft 71. Each of ends of the switching-unit side link unit 74, the end being opposite to an end close to the shaft 71, is connected to each of the movable conductors of the two vacuum interrupters.

The power transmission mechanism such as the link unit is not limited to the mode described herein. When a plurality of switching units are disposed in a vertical direction, and if each switching unit can be operated at one of the above-described timings, the footprint can be reduced while the effects described in Embodiments 1 and 2 are provided.

As a possible measure for achieving such a timing, specifically, the gap distance of the disconnecting vacuum interrupter 3 in the opened state is set shorter than the gap distance of the breaking vacuum interrupter 2 in the opened state, thereby the disconnecting vacuum interrupter 3 is first closed, so that effects similar to those in Embodiment 1 can be provided.

It will be appreciated that the electromagnet may not be necessarily provided in the operating unit not only in Embodiment 1 but also in each of Embodiments 2 and 3. Moreover, although the vacuum interrupter is used in the switching unit in each of Embodiments, the vacuum interrupter may not be exclusively used. Using the vacuum interrupter allows the switch to be small and reliable.

REFERENCE SIGNS LIST

1 . . . switch
2 . . . breaking vacuum interrupter
3 . . . disconnecting vacuum interrupter
21, 22 . . . electromagnet
41 . . . shaft
42, 43 . . . wipe spring
44, 45 . . . breaking spring
50, 51 . . . capacitor
52 . . . control circuit board
64, 65 . . . main switch
SMAG . . . stroke of electromagnet
S1, S2 . . . gap distance of vacuum interrupter
W1, W2 . . . wipe length

The invention claimed is:

1. A switch, comprising:

a first switching unit and a second switching unit, each including a fixed electrode and a movable electrode that is disposed opposite the fixed electrode and is closed or opened;

a first electromagnet configured to move the movable electrode of the first switching unit;

a second electromagnet configured to move the movable electrode of the second switching unit;

a power source;

a first capacitor configured to supply power to the first electromagnet;

a second capacitor configured to supply power to the second electromagnet, wherein the first capacitor and the second capacitor are connected in parallel to the power source and are configured to discharge independently;

a first switch disposed between the first electromagnet and the first capacitor; and a second switch disposed between the second electromagnet and the second capacitor.

2. The switch according to claim 1, wherein the switching units are configured such that the second switching unit first starts an opening operation, and then the first switching unit starts an opening operation.

3. The switch according to claim 2, wherein the switching units are configured such that the second switching unit first starts the opening operation, and after the lapse of time of at least one cycle of an AC frequency applied to the switch, the first switching unit starts the opening operation.

4. The switch according to claim 1, wherein the first electromagnet has a movable section configured to transmit the driving force via a first spring to a first shaft thereby moving the moveable electrode of the first switching unit, wherein the second electromagnet has a moveable section configured to transmit the driving force via a second spring to a second shaft thereby moving the moveable electrode of the second switching unit, and wherein a distance between the movable electrode and the fixed electrode of the first switching unit in an opened state is less than a distance between the movable electrode and the fixed electrode of the second switching unit in an opened state.

5. The switch according to claim 4, wherein the first switching unit and the second switching unit are arranged in a vertical direction.

6. The switch according to claim 1, wherein the first switching unit is first closed, and after the lapse of time of at least a half cycle of an AC frequency applied to the switch, the second switching unit is closed.

7. The switch according to claim 1, wherein the first switching unit is a disconnecting unit having an anti-surge function, and the second switching unit is a breaking unit having a current breaking function.

8. The switch according to claim 1, wherein each of the switching units accommodates the fixed electrode and the movable electrode within a vacuum valve having a vacuum inside.

9. The switch according to claim 1, further comprising:

a first diode disposed between the first capacitor and the power source; and a second diode disposed between the second capacitor and the power source.

10. A switch, comprising:

a first switching unit and a second switching unit that are electrically connected in series, each including a fixed electrode and a movable electrode that is disposed opposite the fixed electrode and is closed or opened with respect to the fixed electrode;

a first electromagnet connected to the first switching unit via a first shaft that generates a driving force for moving the moveable electrode of the first switching unit;

a second electromagnet connected to the second switching unit via a second shaft that generates a driving force for moving the moveable electrode of the second switching unit;

a control circuit including:

a first capacitor configured to discharge power to the first electromagnet and a second capacitor configured to discharge power to the second electromagnet, wherein each of the first capacitor and the second capacitor are configured to discharge independently of each other;

a charging circuit;

a first diode connected to the charging circuit and a second diode connected to the charging circuit, wherein the first capacitor and the second capacitor are connected in parallel to the charging circuit via the first diode and the second diode, respectively;

one switch for the first capacitor, that when closed, discharges the first capacitor and one switch for the second capacitor, that when closed, discharges the second capacitor, wherein the one switch for the first capacitor is disposed between the first electromagnet and the first capacitor such that closing the one switch for the first capacitor completes a circuit between the first capacitor and the first electromagnet to discharge power to the first electromagnet, and the closing of the one switch for the first capacitor does not discharge the second capacitor, and wherein the one switch for the second capacitor is disposed between the second electromagnet and the second capacitor such that closing the one switch for the second capacitor completes a circuit between the second capacitor and the second electromagnet to discharge power to the second electromagnet, and the closing of the one switch for the second capacitor does not discharge the first capacitor.

* * * * *